US006934983B1

(12) United States Patent
Johnston

(10) Patent No.: US 6,934,983 B1
(45) Date of Patent: Aug. 30, 2005

(54) HAMMOCK HANGING APPARATUS

(76) Inventor: Johnny R. Johnston, P.O. Box 806, Miami, OK (US) 74355

( * ) Notice: Subject to any disclaimer, the term of this patent is extended or adjusted under 35 U.S.C. 154(b) by 29 days.

(21) Appl. No.: 10/909,662

(22) Filed: Aug. 2, 2004

(51) Int. Cl.[7] ..... A45F 3/24

(52) U.S. Cl. ..... 5/127; 182/135; 182/187; 248/219.1

(58) Field of Search ..... 5/127, 128, 120, 5/129, 130, 121; 182/133, 135, 187, 20; 248/219.1

(56) References Cited

U.S. PATENT DOCUMENTS

| | | | | |
|---|---|---|---|---|
| 672,228 A | | 4/1901 | Huff | 5/127 |
| 2,382,528 A | | 8/1945 | Anderegg | 5/128 |
| 4,744,537 A | | 5/1988 | Buckley | 248/219.1 |
| 5,579,548 A | * | 12/1996 | Death | 5/127 |
| 6,059,240 A | | 5/2000 | Gorsuch | 248/219.4 |
| 6,467,110 B1 | | 10/2002 | Ketcher | 5/127 |

* cited by examiner

*Primary Examiner*—Alexander Grosz
(74) *Attorney, Agent, or Firm*—William R. Sharp

(57) ABSTRACT

An apparatus is provided for hanging a hammock with opposing ends using a single vertical support, comprising: an elongated arm having opposing ends and a longitudinal axis; a butt plate fixedly connected to one end of the arm so as to be substantially perpendicular to the longitudinal axis of the arm; a suspension mechanism having a first portion, for circumferentially extending around the vertical support, and a second portion for extending downwardly from the first portion to the arm for connection thereto at first and second longitudinally spaced connection points to thereby securely support the arm, with the butt plate abutting the vertical support such that the arm extends outwardly and substantially horizontally from the vertical support; a gripper belt for circumferentially extending at least partially around the vertical support so as to securely hold the butt plate in its position abutting the vertical support; and a hammock hanging mechanism for connection of the opposing ends of the hammock to the arm at respective third and fourth longitudinally spaced connection points, the third connection point being longitudinally adjacent to the first connection point and the fourth connection point being longitudinally adjacent to the second connection point.

17 Claims, 3 Drawing Sheets

HAMMOCK HANGING APPARATUS

BACKGROUND OF THE INVENTION

The invention relates to an apparatus for hanging a hammock using a single vertical support, such as a tree, pole, or post.

A hammock is typically hung between two vertical supports. However, two supports spaced the proper distance apart are not always available. The prior art addresses this problem with devices that use only a single support for hanging a hammock. However, such devices suffer from the disadvantage of requiring hardware that must be screwed or driven deeply into the support, causing damage and marring of the vertical support. This is most critical for a tree, whose health as a growing plant can be adversely affected.

SUMMARY OF THE INVENTION

It is, therefore, an object of the invention to provide an apparatus for hanging a hammock that uses only a single vertical support and does not require potentially damaging hardware.

The above object is realized by an apparatus for hanging a hammock with opposing ends using a single vertical support, comprising: an elongated arm having opposing ends and a longitudinal axis; a butt plate fixedly connected to one end of the arm so as to be substantially perpendicular to the longitudinal axis of the arm; a suspension means having a first portion, for circumferentially extending around the vertical support, and a second portion for extending downwardly from the first portion to the arm for connection thereto at first and second longitudinally spaced connection points to thereby securely support the arm, with the butt plate abutting the vertical support such that the arm extends outwardly and substantially horizontally from the vertical support; a gripper means for circumferentially extending at least partially around the vertical support so as to securely hold the butt plate in its position abutting the vertical support; and hammock hanging means for connection of the opposing ends of the hammock to the arm at respective third and fourth longitudinally spaced connection points, the third connection point being longitudinally adjacent to the first connection point and the fourth connection point being longitudinally adjacent to the second connection point.

Without the need for any hardware that can damage the single vertical support, the suspension means securely supports the arm and one or more persons lying in a hammock as hung from the arm, and the gripper means (i.e. "gripper belt") safely and securely holds the butt plate and the arm as fixedly connected thereto in their desired position. The preferred gripper belt includes gripper plates that can firmly grip the vertical support without causing damage. According to one embodiment, the first portion of the suspension means preferably comprises a chain, used primarily with a tree as the vertical support. Portions of the chain pass over tree limbs to prevent downward slippage of the chain. According to another embodiment, the first portion of the suspension means comprises a cable received by a second gripper belt which assists in holding the cable in its desired vertical position. Accordingly, the vertical support in this embodiment can be a pole, post, or a tree without limbs at the desired vertical position of the first portion of the suspension means. In each embodiment, the second portion of the suspension means can comprise at least one cable.

According to another desirable feature, the arm can include multiple arm portions held securely together by a tensioner mechanism. In disassembled form, the arm portions are easier and more cost efficient to package and ship than the arm as a single piece in its full length.

DETAILED DESCRIPTION OF THE INVENTION

In the following description, it is understood that one member is "fixedly connected" to another member with a suitable weld.

Figure 1:
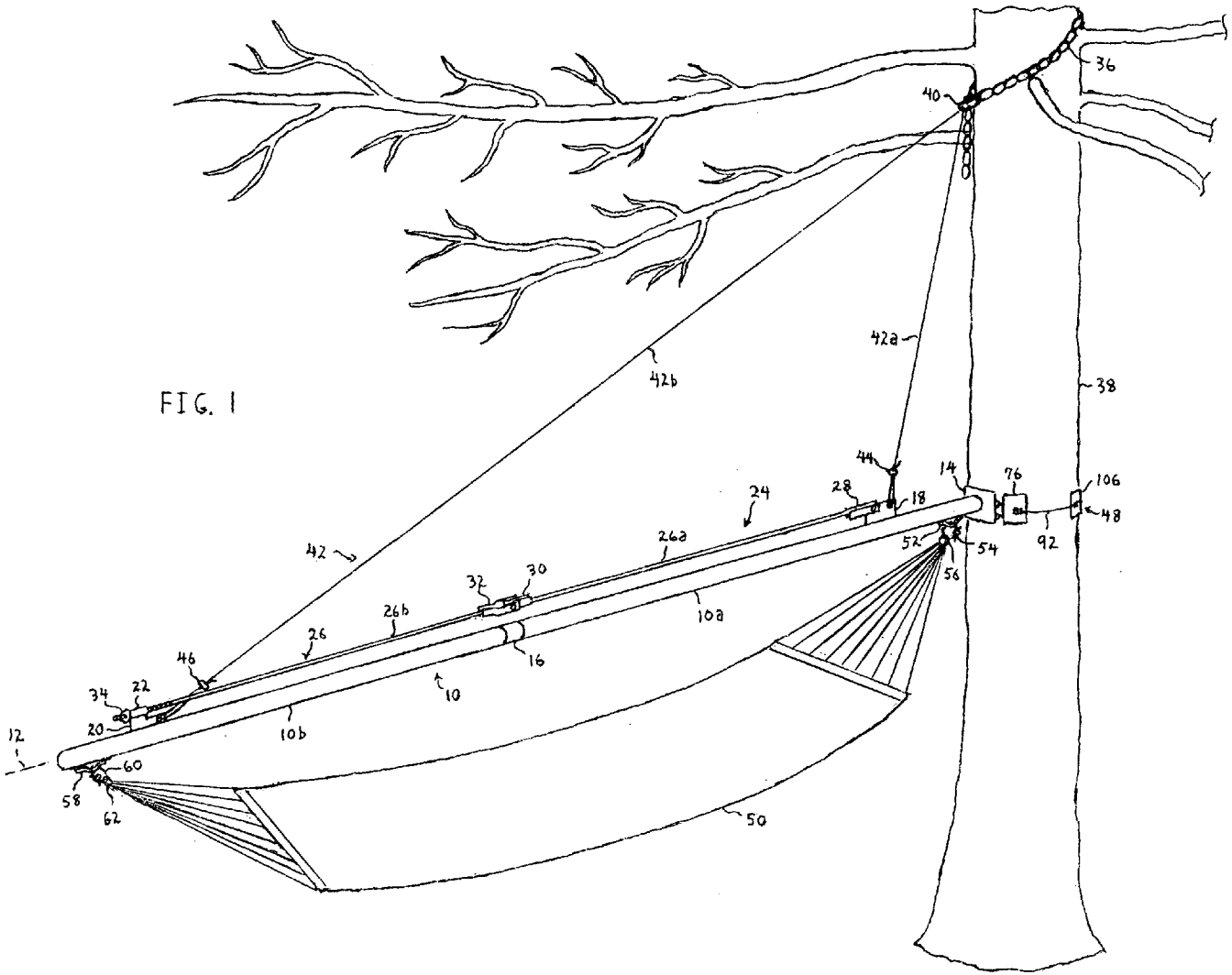
FIG. 1 is a perspective view of one embodiment of the invention using a tree as the single vertical support, and having a chain as described above and an arm with two arm portions.

Referring to FIG. 1, the illustrated apparatus includes an elongated arm 10 having opposing ends, and also having a longitudinal axis 12. A butt plate 14, discussed further below, is fixedly connected to one end of arm 10 (considered the inner end) so as to be substantially perpendicular to longitudinal axis 12. For the sake of convenience in the following discussion, of the opposing ends of a member, the end most closely adjacent longitudinally to butt plate 14 will be referred to as the inner end, and the opposing end will be referred to as the outer end.

Arm 10 includes two arm portions 10*a* and 10*b*, and a coupling member 16 that joins the adjacent arm portions together. Arm portion 10*a* defines the inner end of arm 10 and arm portion 10*b* defines the outer end of the arm. Of course, arm 10 has diametrically opposing upper and lower sides. On the upper side of arm portion 10*a* there is fixedly connected thereto a flange 18. A flange 20, having a sleeve 22 at its upper end, is fixedly connected to the upper side of arm portion 10*b*. As is apparent from FIG. 1, flanges 18 and 20 are longitudinally spaced from one another.

A tensioner mechanism 24 includes a bar 26 comprised of two bar portions 26*a* and 26*b*. Bar portion 26*a* extends between linkage member 28 and linkage member 30. An inner end of bar portion 26*a* is fixedly connected to linkage member 28, and an outer end of bar portion 26*a* is fixedly connected to linkage member 30. Linkage member 28 is removably connected to flange 18 by any suitable means, such as a bolt and nut. Bar portion 26*b* extends between linkage member 32 and sleeve 22 of flange 20. An inner end of bar portion 26*b* is fixedly connected to linkage member 32, which is removably connected to linkage member 30 by any suitable means, such as a bolt and nut. A section of bar portion 26*b* adjacent to its outer end is threaded and received through sleeve 22. A nut 34 of tension mechanism 24 is threadedly received on the threaded outer end section of bar portion 26*b* so as to be tightenable against sleeve 22 to place bar 26 under tension. Each of the above-mentioned linkage members is not limited to any particular structure, but can take the form of parallel plates between which a corresponding end of a bar portion is fixedly connected.

In general, then, tensioner mechanism 24 comprises: a bar 26 extending between and connecting arm portions 10*a* and 10*b*; and a nut 34 received on a threaded end section of bar 26 that can be tightened to place the bar under tension, and can also be employed to adjust the tension. Nut 34 is tightened to increase the tension, and loosened to decrease the tension. Bar 26 as under tension urges arm portions 10*a* and 10*b* toward one another to hold the arm portions together via coupling member 16.

Although the arm in the illustrated embodiment has two arm portions, it should be apparent that the arm could include more than two arm portions if desired. In disassembled form, multiple arm portions are easier and more cost efficient to package and ship than the arm as a single piece in its full length.

A chain 36 circumferentially extends around tree 38, with two links of the chain connected with a conventional link connector 40. Link connector 40 is, of course, removable, and chain 36 is of sufficient length to thereby allow the circumference of that portion of the chain surrounding tree 38 to be increased when necessary as the tree grows. Portions of chain 36 pass over sturdy tree limbs, as shown, to prevent downward slippage of the chain. A cable 42 is preferably received through link connector 40 to form two cable sections 42*a* and 42*b*. Cable section 42*a* extends downwardly from chain 36 to flange 18, which has a hole for receiving therethrough an end portion of cable section 42*a* so as to form a loop secured with a suitable cable clamp 44. Cable section 42*a* is thereby connected to arm 10, and arm portion 10*a* in particular, by means of flange 18. Therefore, flange 18 functions as a connector member corresponding to a first connection point for cable 42. Similarly, cable section 42*b* extends downwardly from chain 36 to flange 20, which has a hole for receiving therethrough an end portion of cable section 42*b* so as to form a loop secured with a suitable cable clamp 46. Cable section 42*b* is thereby connected to arm 10, and arm portion 10*b* in particular, by means of flange 20, which functions as a connector member corresponding to a second connection point for cable 42. Of course, the first and second connection points are longitudinally spaced. Accordingly, chain 36 and cable 42 function together as a suspension means that securely supports arm 10, with butt plate 14 abutting tree 38 such that arm 10 extends outwardly and substantially horizontally from tree 38 as shown.

Chain 36 and cable 42 should be of a size and strength capable of bearing loads in excess of maximum anticipated loads for optimum safety. The stress on cable 42 is minimized by the above-mentioned tensioner mechanism 24, which performs the additional function of sharing the load of cable sections 42*a* and 42*b*.

Gripper belt 48 circumferentially extends partially around tree 38 so as to securely and safely hold butt plate 14 in its position abutting tree 38, thereby also assisting in securely holding arm 10 as connected to butt plate 14 in its desired position. Gripper belt 48 not only stabilizes arm 10, preventing undesirable movement of arm 10 when the apparatus is in use, the gripper belt is also an important safety feature. Without gripper belt 48, butt plate 14 and affixed arm 10 could be pulled away from tree 38, causing arm 10 to swing dangerously from its intended position, posing a risk of serious injury to anyone nearby. In addition, a gripper belt 48 is adjustable to allow for growth of tree 38 in a manner discussed further below.

A hammock 50 is hung from arm 10 in the illustrated embodiment as will now be described. A connector member 52 is fixedly connected to the lower side of arm portion 10*a*, and defines an opening through which is received a short length of cable 54. Cable 54 is also received through an eye 56 at the inner end of hammock 50. As shown, cable 54 has opposing ends that are secured together by, for example, a suitable cable clamp to form a closed loop connecting the inner end of hammock 50 to arm 10, and arm 10*a* in particular, by means of connector member 52. Connector member 52 corresponds to a third connection point, which is longitudinally adjacent to the first connection point to which flange 18 corresponds. Similarly, a connector member 58 is fixedly connected to the lower side of arm portion 10*b*, and defines an opening through which is received a short length of cable 60. Cable 60 is also received through an eye 62 at the outer end of hammock 50. As shown, cable 60 has opposing ends that are secured together by, for example, a suitable cable clamp to form a closed loop connecting the outer end of hammock 56 to arm 10, and arm 10*b* in particular, by means of connector member 58. Connector member 58 corresponds to a fourth connection point, which is longitudinally spaced from the above-mentioned third connection point and is longitudinally adjacent to the second connection point to which flange 20 corresponds.

Figure 2:
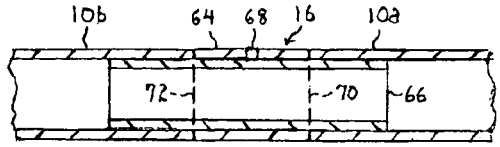
FIG. 2 is a fragmentary cross-sectional view of the two arm portions as joined together by a coupling member.

Referring to FIG. 2, this longitudinal cross-sectional view shows arm portions 10*a* and 10*b* to be pipes, as is preferred. FIG. 2 further illustrates that coupling member 16 comprises a short external pipe 64 and a longer internal pipe 66 that is fixedly connected to external pipe 64 so that such external pipe is intermediate to the inner and outer ends of internal pipe 66. The fixed connection between external pipe 64 and internal pipe 66 is preferably provided by a spot weld 68 through a hole in the wall of the external pipe. The outer end of arm portion 10*a* abuts but is not connected to the inner end of external pipe 64 as indicated at 70, and the inner end of arm portion 10*b* abuts but is not connected to the outer end of external pipe 64 as indicated at 72. Broken lines indicate where abutting ends of external pipe 64 and the arm portions are obscured by internal pipe 66. That portion of internal pipe 66 which extends beyond the inner end of external pipe 64 is closely received by but not connected to arm portion 10*a* adjacent to its outer end. That portion of internal pipe 66 which extends beyond the outer end of external pipe 64 is closely received by but not connected to arm portion 10*b* adjacent to its inner end. Accordingly, coupling member 16, as comprised by external pipe 64 and internal pipe 66, joins arm portions 10*a* and 10*b* but allows disassembly thereof.

In the following description of FIGS. 3–6, with regard to a plate having loops, and/or one or more eyes, and/or a sleeve, it is understood that such loops and/or eye(s) and/or sleeve are fixedly connected to the plate.

Figure 3:
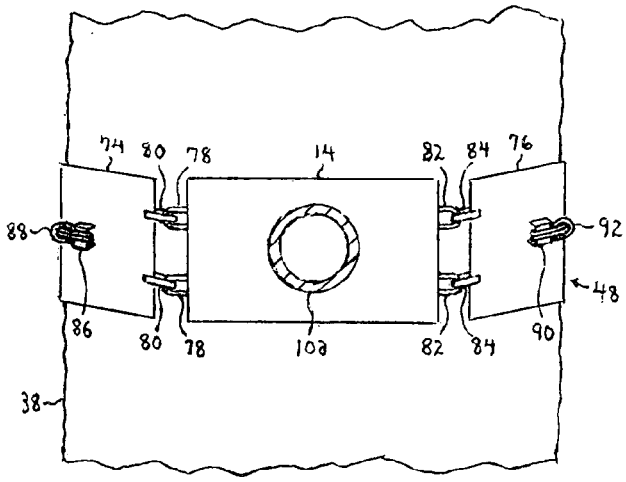
FIG. 3 is a view that cuts through the arm to show it in cross section, and further shows the butt plate and a "front" portion of a gripper belt as connected to the butt plate.

Referring to FIG. 3, this view shows arm portion 10*a* in transverse cross section, butt plate 14 as fixedly connected to the inner end of arm portion 10*a*, and a pair of gripper plates 74 and 76 of the front portion of gripper belt 48. A pair of loops 78 extend from a first side of butt plate 14, and a pair of loops 80 extend from one side of gripper plate 74 and interconnect with loops 78 to thereby hingedly connect gripper plate 74 to the first side of the butt plate. Similarly, a pair of loops 82 extend from a second side of butt plate 14, and a pair of loops 84 extend from one side of gripper plate 76 and interconnect with loops 82 to hingedly connect gripper plate 76 to the second side of the butt plate, which is transversely opposite the first side. Gripper plate 74 also has an eye 86 to which a doubled cable 88 is connected. The connection is made by forming a loop in cable 88, passing the doubled cable through eye 86, and then back through the loop. Gripper plate 76 has an eye 90 to which a doubled cable 92 is connected in the same manner as cable 88 is connected to eye 86.

Figure 4:
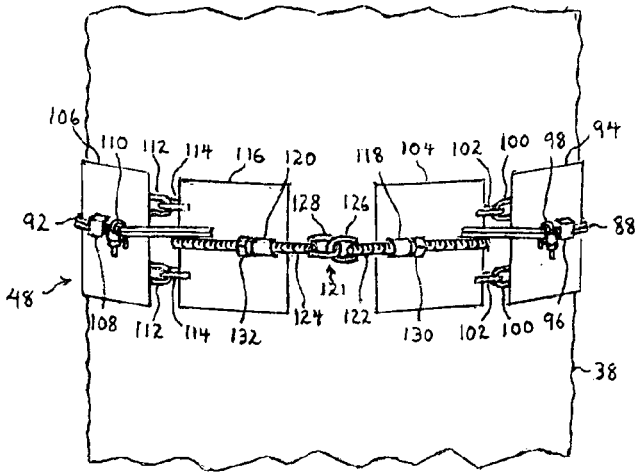
FIG. 4 is a view of a "back" portion of the gripper belt.

Referring to FIG. 4, doubled cable 88 extends to the illustrated back portion of gripper belt 48 as shown. Gripper plate 94 has an eye 96 that receives an end portion of doubled cable 88 therethrough. Doubled cable 88 is held in position by a cable clamp 98 which abuts eye 96. Therefore, doubled cable 88 connects gripper plate 94 to gripper plate 74 (FIG. 3). Gripper plate 94 further has a pair of loops 100 which extend from one side of such gripper plate and interconnect with a pair of loops 102 extending from one side of an adjacent gripper plate 104. Gripper plate 94 is thereby hingedly connected to gripper plate 104. Like doubled cable 88, doubled cable 92 extends to the illustrated back portion of gripper belt 48. Similarly to gripper plate 94, gripper plate 106 has an eye 108 that receives an end portion of doubled cable 92 therethrough. Doubled cable 92 is held in position by a cable clamp 110 which abuts eye 108. Therefore, doubled cable 92 connects gripper plate 106 to gripper plate 76 (FIG. 3). Gripper plate 106 further has a pair of loops 112 which extend from one side of such gripper plate and interconnect with a pair of loops 114 extending from one side of an adjacent gripper plate 116. Gripper plate 106 is thereby hingedly connected to gripper plate 116.

As further shown in FIG. 4, gripper plate 104 has a sleeve 118 and gripper plate 116 has a sleeve 120. A bolt member 121 has a section of bolt stock 122 received through sleeve 118, and a section of bolt stock 124 received through sleeve 120. Loops 126 and 128 are fixedly connected to respective ends of bolt stock sections 122 and 124 between gripper plates 104 and 116. Loops 126 and 128 are interconnected such that bolt stock sections 122 and 124 are hingedly connected. A nut 130 is threadedly received on bolt stock section 122 so as to be tightenable against sleeve 118, and a nut 132 is threadedly received on bolt stock section 124 so as to be tightenable against sleeve 120. As should be apparent from the FIGURES, gripper plates 104 and 116 as well as bolt member 121 are approximately diametrically opposite butt plate 14 (FIG. 3).

Bolt member 121 and associated nuts 130 and 132 provide a means of adjusting gripper belt 48. Nuts 130 and 132 can be tightened to increase the tension on gripper belt 48, or can be loosened to decrease such tension. As tree 38 grows, nuts 130 and 132 can be gradually loosened to increase the circumferential spacing between gripper plates 104 and 116 and thereby increase the circumference of gripper belt 48. Once nuts reach the ends of bolt stock sections 122 and 124 opposite loops 126 and 128, the circumference of gripper belt 48 can be further enlarged by loosening cable clamps 98 and 110 and lengthening the portions of doubled cables 88 and 92 extending between gripper plates 94 and 74 (FIG. 3) and between gripper plates 106 and 76 (FIG. 3). Bolt member 121 can then be reinstalled. Although not shown, with increases in the circumferential spacing between gripper plates 94 and 74 and between 106 and 76, and when first installing gripper belt 48 on a very large tree, it may be desirable to add a gripper plate between gripper plates 94 and 74 which has an eye for receiving doubled cable 88 therethrough as well as a gripper plate between gripper plates 106 and 76 which has an eye for receiving doubled cable 92 therethrough. These additional gripper plates can prevent doubled cables 88 and 92 from cutting into the tree and causing damage.

With respect to the various hinged connections between gripper plates and sections of bolt stock in gripper belt 48 described above, such connections allow use of the gripper belt on different sizes of trees, and further accommodates growth of the tree around which the gripper belt extends.

For the sake of clarity, components of gripper belt 48 shown in FIGS. 3 and 4 that are visible in FIG. 1 are indicated with reference characters therein, including gripper plate 76, doubled cable 92, and gripper plate 106.

Figure 5:
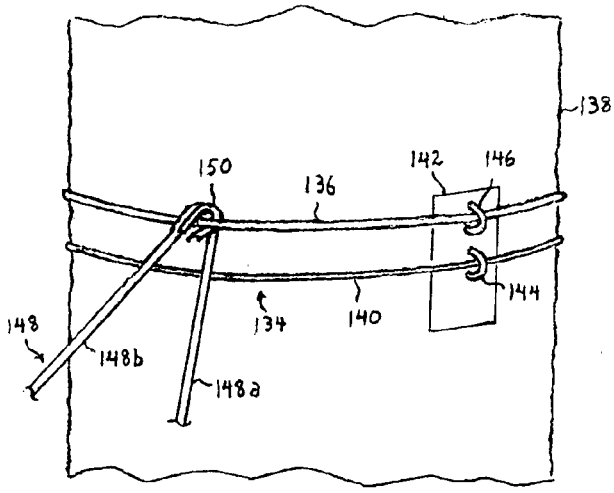
FIG. 5 is a view of a portion of an alternative embodiment which employs a cable in conjunction with a second gripper belt instead of the chain used in the embodiment of FIG. 1.

Referring to FIG. 5, the illustrated alternative to the chain shown in the embodiment of FIG. 1 shows a gripper belt 134 and a cable 136 that circumferentially extend at least partially around tree 138. The portion of gripper belt 134 visible in this view includes a cable 140 and a gripper plate 142 having an eye 144 through which cable 140 is received. Cable 136 is preferably larger in diameter than cable 140, and gripper plate 142 has an eye 146 for receiving cable 136 therethrough. A cable 148 is received behind cable 136 and over a cable guide 150, which helps to prevent flattening of cables 136 and 148. Cable 148 comprises cable sections 148*a* and 148*b*. Like cable sections 42*a* and 42*b* in FIG. 1, cable sections 148*a* and 148*b* extend downwardly to spaced connection points on an arm having a hammock (not shown) hung therefrom. Cables 136 and 148 should be of a size and strength capable of bearing loads in excess of maximum anticipated loads.

Figure 6:
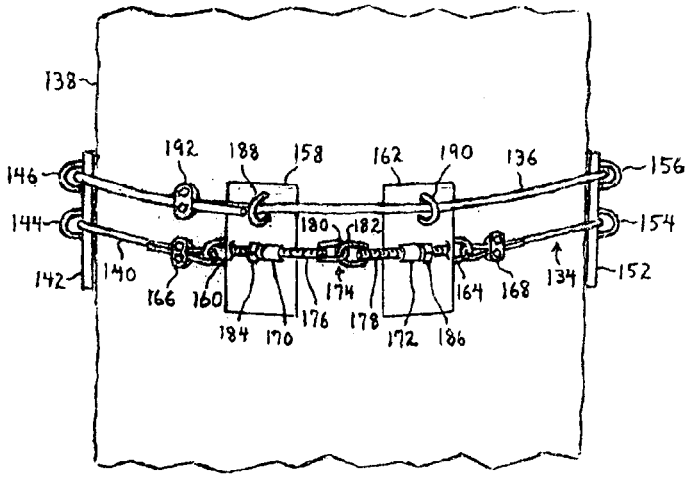
FIG. 6 is another view of the cable and gripper belt shown in FIG. 5.

Referring to FIG. 6, this view of gripper belt 134 and cable 136 shows gripper plate 142, as is also shown from a different perspective in FIG. 5, and a gripper plate 152 diametrically opposite gripper plate 142. Similarly to gripper plate 142, gripper plate 152 has eyes 154 and 156 for respectively receiving cables 140 and 136 therethrough. Gripper belt 134 further includes gripper plate 158 having an eye 160 extending from a side thereof, and a gripper plate 162 having an eye 164 extending from a side thereof. Opposing end portions of cable 140 are respectively received through eyes 160 and 164 so as to form loops secured with cable clamps 166 and 168. Cable 140 is thereby connected to gripper plate 158 and to gripper plate 162 so as to extend partially around tree 138 from gripper plate 158 to gripper plate 162.

Gripper belt 134 has an adjustment mechanism similar to that previously described with reference to gripper belt 48. Gripper plate 158 has a sleeve 170 and gripper plate 162 has a sleeve 172. A bolt member 174 has a section of bolt stock 176 received through sleeve 170, and a section of bolt stock 178 received through sleeve 172. Portions of bolt stock sections 176 and 178 are broken away so as to not obscure components of gripper belt 134. Loops 180 and 182 are fixedly connected to respective ends of bolt stock sections 176 and 178 between gripper plates 158 and 162. Loops 180 and 182 are interconnected such that bolt stock sections 176 and 178 are hingedly connected (having the same advantages as the similar connection in FIG. 4). A nut 184 is threadedly received on bolt stock section 176 so as to be tightenable against sleeve 170, and a nut 186 is threadedly received on bolt stock section 178 so as to be tightenable against sleeve 172. Bolt stock sections 176 and 178 and associated nuts 184 and 186 provide for adjustment of gripper belt 134 in the same manner as discussed with respect to gripper belt 48.

Gripper plates 158 and 162 also have eyes 188 and 190, respectively, for receiving cable 136 therethrough. Opposing end portions of cable 136 (of which only one is visible) are secured together with cable clamp 192. As tree 138 grows, cable clamp 192 will need to be periodically loosened to increase the circumference of cable 136, and nuts 184 and 186 will be loosened to correspondingly increase the circumference of gripper belt 134.

In view of the foregoing discussion, gripper belt 134 assists in holding cable 136 in its desired vertical position. Therefore, tree 138 does not need limbs at such vertical position as in the embodiment of FIG. 1.

Figure 7:
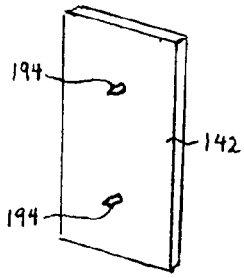
FIG. 7 is a perspective view showing the back face of one gripper plate from the second gripper belt of FIGS. 5 and 6 when disassembled.

Referring to FIG. 7, this view of gripper plate 142 shows its back face as having teeth 194 extending outwardly therefrom. Such teeth further assist in avoiding slippage. Teeth 194 should preferably be no more than about ¼ inch in length, thereby avoiding any damage to tree 138 while still performing their desired function. The other gripper plates of gripper belt 134 also preferably have similar teeth on their back faces. If desired, gripper plates of gripper belt 48 (FIGS. 3 and 4) could also have teeth on their back faces. Structures other than teeth could be employed to avoid slippage, as long as they cause no damage to the tree.

The preferred material for components of the apparatus is steel (except of course the hammock), including the cables comprised of steel wire.

Obviously, many modifications and variations of the present invention are possible in light of the above teachings. For example, some gripper plates of the gripper belts could be omitted, especially for a tree having a diameter of 12 inches or less and not expected to grow appreciably. However, at least the pair of gripper plates receiving the bolt member are employed in the types of gripper belts described for minimal gripping and adjustment capability. Or, under very broad aspects of the invention, the gripper belts could include only a cable, or even a nylon rope, and a ratchet mechanism for adjustment purposes. Such a gripper belt would, however, cut into and damage the tree and would not grip the tree as well as a gripper belt with gripper plates. The mechanism including the hinged bolt member and associated nuts, as described above, is also superior for adjustment purposes with respect to ease of use, mechanical simplicity, and usability with associated gripper plates. It is, therefore, to be understood that within the scope of the appended claims the invention can be practiced otherwise than as specifically described.

That which is claimed is:

1. An apparatus for hanging a hammock with opposing ends using a single vertical support, comprising:

an elongated arm having opposing ends and a longitudinal axis;

a butt plate fixedly connected to one end of the arm so as to be substantially perpendicular to the longitudinal axis of the arm;

a suspension means having a first portion, for circumferentially extending around the vertical support, and a second portion for extending downwardly from the first portion to the arm for connection thereto at first and second longitudinally spaced connection points to thereby securely support the arm, with the butt plate abutting the vertical support such that the arm extends outwardly and substantially horizontally from the vertical support;

a gripper means for circumferentially extending at least partially around the vertical support so as to securely hold the butt plate in its position abutting the vertical support; and hammock hanging means for connection of the opposing ends of the hammock to the arm at respective third and fourth longitudinally spaced connection points, the third connection point being longitudinally adjacent to the first connection point and the fourth connection point being longitudinally adjacent to the second connection point.

2. An apparatus as recited in claim 1 wherein the arm includes a plurality of arm portions and at least one coupling member for joining adjacent arm portions together, a first arm portion defining the one end of the arm connected to the butt plate and a second arm portion defining the other end of the arm, and wherein the apparatus further comprises a tensioner means for connecting and urging toward one another the first arm portion and the second arm portion.

3. An apparatus as recited in claim 2 wherein the tensioner means comprises: a bar for extending between and connecting the first and second arm portions so that the bar is under tension; and a means for adjusting said tension.

4. An apparatus as recited in claim 1 wherein the first portion of the suspension means comprises a chain.

5. An apparatus as recited in claim 4 wherein the second portion of the suspension means comprises at least one cable.

6. An apparatus as recited in claim 1 wherein the first portion of the suspension means comprises a cable.

7. An apparatus as recited in claim 6 wherein the gripper means for holding the butt plate in abutment with the vertical support is denoted as the first gripper means, and wherein the apparatus further comprises a second gripper means for circumferentially extending at least partially around the vertical support and which includes a plurality of gripper plates having respective eyes for receiving the cable therethrough.

8. An apparatus as recited in claim 7 wherein the plurality of gripper plates includes a first gripper plate and a second gripper plate, the first gripper plate having a first eye for receiving the cable therethrough and also having a first sleeve, and the second gripper plate having a second eye for receiving the cable therethrough and also having a second sleeve, wherein the apparatus further comprises: a bolt member having a first section of bolt stock receivable through the first sleeve and a second section of bolt stock receivable through the second sleeve; and first and second nuts, the first nut being threadedly receivable by the first section of bolt stock so as to be tightenable against the first sleeve, and the second nut being threadedly receivable by the second section of bolt stock so as to be tightenable against the second sleeve.

9. An apparatus as recited in claim 8 wherein the first and second sections of bolt stock are hingedly connected.

10. An apparatus as recited in claim 9 wherein the cable as the first portion of the suspension means is denoted as the first cable, and wherein the second gripper means further includes a second cable for connection to the first gripper plate and to the second gripper plate so as to extend partially around the vertical support from the first gripper plate to the second gripper plate.

11. An apparatus as recited in claim 10 wherein the second portion of the suspension means comprises at least one third cable.

12. An apparatus as recited in claim 1 wherein the gripper means is substantially inelastic.

13. An apparatus as recited in claim 12 wherein the gripper means includes a plurality of gripper plates.

14. An apparatus as recited in claim 13 wherein the plurality of gripper plates include a first gripper plate with a first sleeve and a second gripper plate with a second sleeve, and wherein the apparatus further comprises: a bolt member having a first section of bolt stock receivable through the first sleeve and a second section of bolt stock receivable through the second sleeve; and first and second nuts, the first nut being threadedly receivable by the first section of bolt stock so as to be tightenable against the first sleeve, and the second nut being threadedly receivable by the second section of bolt stock so as to be tightenable against the second sleeve.

15. An apparatus as recited in claim 14 wherein the first and second sections of bolt stock are hingedly connected.

16. An apparatus as recited in claim 15 wherein the butt plate has transversely opposing sides, and wherein the gripper means further includes: a third gripper plate hingedly connected to the first gripper plate; a fourth gripper plate hingedly connected to the second gripper plate; fifth and sixth gripper plates hingedly connected to respective sides of the butt plate; a first cable for connecting the third gripper plate to the fifth gripper plate; and a second cable for connecting the fourth gripper plate to the sixth gripper plate.

17. An apparatus as recited in claim 1 wherein the arm has diametrically opposing first and second sides, and wherein the arm has first and second connector members fixedly connected to the first side and respectively corresponding to the first and second connection points, and further wherein the arm has third and fourth connection members fixedly connected to the second side and respectively corresponding to the third and fourth connection points.

* * * * *